United States Patent [19]

Maa et al.

[11] Patent Number: 4,485,008

[45] Date of Patent: Nov. 27, 1984

[54] LIQUEFACTION PROCESS

[75] Inventors: Peter S. Maa, Baytown; Lavanga R. Veluswamy, Houston; Lonnie W. Vernon, Baytown, all of Tex.

[73] Assignee: Exxon Research and Engineering Co., Florham Park, N.J.

[21] Appl. No.: 483,076

[22] Filed: Apr. 7, 1983

Related U.S. Application Data

[63] Continuation of Ser. No. 213,449, Dec. 5, 1980, abandoned.

[51] Int. Cl.[3] ..... C10G 1/00; C10G 1/06; C10G 1/08

[52] U.S. Cl. ..... 208/10; 208/8 LE

[58] Field of Search ..... 208/10, 8 LE

[56] References Cited

U.S. PATENT DOCUMENTS

| | | | |
|---|---|---|---|
| 3,813,329 | 5/1974 | Gatsis et al. | 208/9 |
| 4,077,867 | 3/1978 | Aldridge et al. | 208/10 |
| 4,090,943 | 5/1978 | Moll et al. | 208/10 |
| 4,094,766 | 6/1978 | Gorin | 208/8 |
| 4,189,371 | 2/1980 | Maa et al. | 208/10 |
| 4,189,372 | 2/1980 | Baldwin et al. | 208/10 |
| 4,210,518 | 7/1980 | Wilson, Jr. et al. | 208/10 |
| 4,214,974 | 7/1980 | Wurfel | 208/10 |
| 4,222,844 | 9/1980 | Nizamoff | 208/8 LE |
| 4,222,848 | 9/1980 | Carr | 208/10 |
| 4,252,633 | 2/1981 | Long et al. | 208/8 LE |
| 4,283,268 | 8/1981 | Rosenthal et al. | 208/10 |
| 4,331,531 | 5/1982 | Kuehler | 208/10 |
| 4,345,989 | 8/1982 | Vernon | 208/10 |
| 4,347,117 | 8/1983 | Baunan | 208/10 |

FOREIGN PATENT DOCUMENTS

| | | | |
|---|---|---|---|
| 2735609 | 4/1978 | Fed. Rep. of Germany | 208/10 |
| WO80/00155 | 7/1978 | PCT Int'l. Appl. | 208/10 |

OTHER PUBLICATIONS

Bureau of Mines Bulletin 622; U.S. Dept. of the Interior, Bureau of Mines (1965) pp. 24–28.

*Primary Examiner*—Delbert E. Gantz
*Assistant Examiner*—Helane E. Maull
*Attorney, Agent, or Firm*—Wayne Hoover

[57] ABSTRACT

An improved liquefaction process for solid carbonaceous materials wherein at least a portion of the liquefaction is accomplished in the presence of an added hydrogenation catalyst and a solvent containing at least 1.25 wt % donatable hydrogen and in the presence of partially liquefied, solid carbonaceous material at liquefaction conditions. In a preferred embodiment, the liquefaction is accomplished in a plurality of stages and a solvent containing at least 1.25 wt % donatable hydrogen is used in at least one stage, most preferably in the second stage. The partially liquefied solid carbonaceous material may be taken from the bottoms fraction of the effluent from any of the liquefaction stages.

10 Claims, 3 Drawing Figures

LIQUEFACTION PROCESS

This is a continuation of application Ser. No. 213,449, filed Dec. 5, 1980, now abandoned.

BACKGROUND OF THE INVENTION

This invention relates to an improved process for converting coal or similar solid carbonaceous materials. More particularly, this invention relates to an improved process for liquefying coal and similar carbonaceous substances.

As is well known, coal has long been used as a fuel in many areas. For several reasons, such as handling problems, waste disposal problems, pollution problems and the like, coal has not been a particularly desirable fuel from the ultimate consumers point of view. Moreover, coal cannot be used directly, in areas where a liquid or gaseous fuel is required. As a result, oil and gas have enjoyed a dominant position, from the standpoint of fuel sources throughout the world.

As is also well known, proven petroleum and gas reserves are shrinking throughout the world and the need for alternate sources of energy is becoming more and more apparent. One such alternate source is, of course, coal since coal is an abundant fossil fuel in many countries throughout the world. Before coal will be widely accepted as a fuel, however, it is believed necessary to convert the same to a form which will not suffer from the several disadvantages alluded to previously and which will permit use in those areas where liquid or gaseous fuels are normally required.

To this end several processes wherein coal is either liquefied and/or gasified have been proposed heretofore. Of these, the processes wherein coal is liquefied appear to be more desirable since a broader range of products is produced and these products are more readily transported and stored.

Of the several liquefaction processes which have been heretofore proposed, those processes wherein coal is liquefied in the absence of added catalyst and in the presence of a solvent or diluent have been favored over catalytic processes even though the non-catalytic processes do not result in complete conversion of available carbon to either a liquid or gaseous product. One reason for this preference could be the relatively high cost of the catalyst and the cost associated with its recovery and recycle to the liquefaction. Another reason, however, could be that recycled catalyst tends to be rapidly poisoned and deactivated. In either case, the catalytic processes which have been proposed heretofore have not, on a continuous basis, approached stoichiometric conversion of the available carbon and have not been economically attractive when compared to the thermal conversion processes. Since stoichiometric conversion of available carbon would be most desired, however, the need for an improved catalytic process is believed to be readily apparent.

SUMMARY OF THE INVENTION

It has now been discovered that the foregoing and other disadvantages of the prior art processes can be reduced with the method of the present invention and an improved liquefaction process provided thereby. It is, therefore, an object of this invention to provide an improved catalytic liquefaction process. It is another object of this invention to provide such a liquefaction process wherein the yield of liquid and gaseous products is increased. It is still a further object of this invention to provide such an improved liquefaction process wherein catalyst recovery is not required. The foregoing and other objects and advantages will become apparent from the description set forth hereinafter and from the drawings appended thereto.

In accordance with the present invention, the foregoing and other objects and advantages are accomplished by liquefying a coal or similar solid carbonaceous material in the presence of an added catalyst and recycled bottoms such that at least a portion of the liquefaction is accomplished in the presence of a hydrogen-donor solvent containing at least 1.25 wt % donatable hydrogen at an elevated pressure and temperature. As pointed out more fully hereinafter, the liquefaction may be accomplished in a single stage or a plurality of stages. When the liquefaction is accomplished in a single stage, the entire liquefaction will be accomplished in the presence of a hydrogen-donor solvent containing at least 1.25 wt % donatable hydrogen. When the liquefaction is accomplished in a plurality of stages, however, the hydrogen-donor solvent containing at least 1.25 wt % donatable hydrogen may be used in any one or all of such stages.

DETAILED DESCRIPTION OF THE INVENTION

Figure 1:
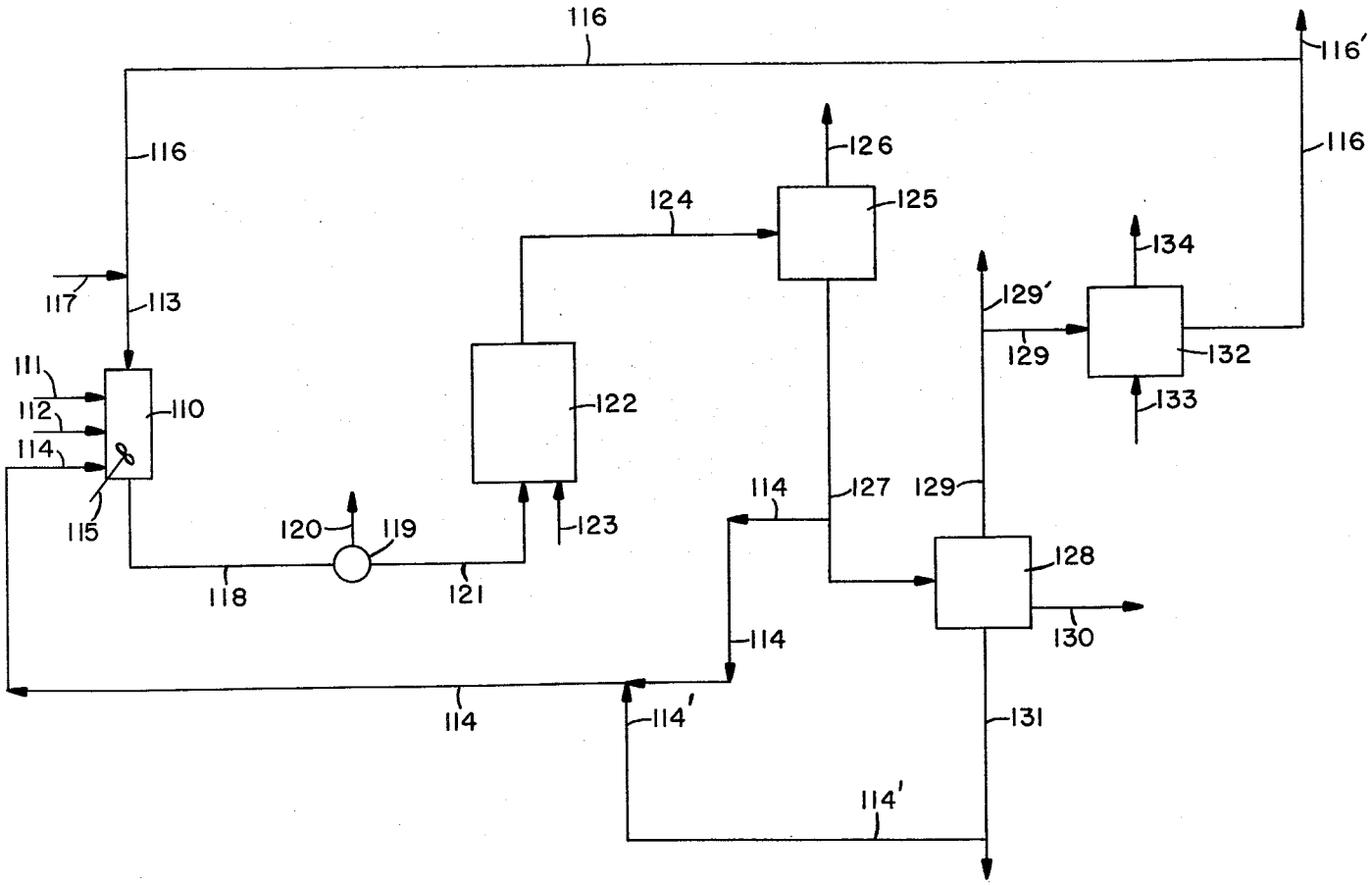
FIG. 1 is a schematic flow diagram of a process within the scope of the present invention.

As indicated, supra, the present invention relates to an improved process for liquefying coal and similar solid carbonaceous materials wherein total carbon conversion in the coal or solid carbonaceous material is increased by effecting at least a portion of the liquefaction in the presence of a catalyst and a hydrogen-donor solvent containing at least 1.25 wt % donatable hydrogen. The liquefaction may be accomplished in a single stage or in a plurality of stages and the catalyst will be present in all stages. The donor solvent, containing at least 1.25 wt % donatable hydrogen, however, may be used in only one stage. Moreover, and as indicated more fully hereinafter, liquefaction in at least one stage will be accomplished in the presence of partially liquefied solid carbonaceous material, which material may be referred to herein as "recycle bottoms".

In general, the method of the present invention can be used to liquefy any solid carbonaceous material which can be hydrogenated, cracked and liquefied. The method of this invention is particularly useful in the liquefaction of coal, coke, wood and similar solid carbonaceous materials containing a relatively high ratio of carbon to hydrogen. In general, any of the coals known in the prior art including anthracite, bituminous coal, subbituminous coal, lignite, peat, brown coal and the like may be liquefied with the method of this invention.

In general, the solid carbonaceous material will be ground to a finely divided state. The particular particle size or particle size range actually employed, however, is not critical to the invention and, indeed, essentially any particle size can be employed. Notwithstanding this, generally, the solid carbonaceous material which is liquefied in accordance with this invention will be ground to a particle size of less than ¼ inch and preferably to a particle size of less than about 8 mesh (nbs sieve size).

After the solid carbonaceous material has been sized, the same will be slurried with a suitable solvent and combined with a suitable catalyst. Normally, the ratio of solvent or diluent to coal (on a moisture-free basis) in the slurry will be within the range from about 0.8:1 to about 10:1 on a weight basis. Ratios in the higher portion of this range will, of course, be required at higher bottoms recycle rates to ensure that the slurry, when bottoms are incorporated, can be transported by pumping or the like.

In general, any of the solvents or diluents known in the prior art to be useful in the liquefaction of coal and similar solid carbonaceous materials may be used as the solvent or diluent in the present invention. When a hydrogen-donor solvent containing at least 1.25 wt % donatable hydrogen is used, any of the solvents or diluents known in the prior art to contain at least 1.25 wt % of donatable hydrogen based on the weight of total solvent can be used in the improved process of this invention. Suitable hydrogen-donor solvents containing at least 1.25 wt % donatable hydrogen include pure compounds as well as mixtures of such compounds in combination with components which will not donate hydrogen at liquefaction conditions. Compounds which will donate hydrogen during liquefaction are believed well known in the prior art and many are described in U.S. Pat. No. 3,867,275. These include the dihydronaphthalenes, the $C_{10}$–$C_{12}$ tetra-hydronaphthalenes, the hexahydrofluorenes, the dihydro-, tetrahydro-, hexahydro- and octahydrophenanthrenes, the $C_{12}$–$C_{13}$ acenaphthenes, the tetrahydro-, hexahydro- and decahydropyrenes, the di-, tetra- and octahydroanthracenes, and other derivatives of partially saturated aromatic compounds. Particularly effective mixed solvents include hydrogenated creosote oil and solvents derived from the liquefaction of coal, particularly distillate fractions having an initial boiling point within the range from about 350° to about 450° F. and a final boiling point within the range from about 700° to about 900° F., which distillate fractions are hydrogenated to contain at least 40 weight percent of hydrogen-donor species.

In general, any catalyst known to exhibit hydrogenation activity may be used in the improved liquefaction process of this invention. Such catalyst include the metals of Group II-B, IV-B, V-B, VI-B, VII-B and VIII of the Periodic Table. Generally, the catalyst or a precursor thereof will be added to the slurry in a form which is readily dispersible or soluble in the solvent or diluent used during liquefaction. Suitable compounds (precursors) convertible to active catalysts under process conditions include (1) inorganic metal compounds such as halides, oxyhalides, hydrated oxides, heteropoly acids (e.g. phosphomolybdic acid, molybdosilisic acid); (2) metal salts of organic acids such as acyclic and alicyclic aliphatic carboxylic acids containing two or more carbon atoms (e.g. toluic acid); sulfonic acids (e.g. toluene-sulfonic acid); sulfinic acids; mercaptans, xanthic acid; phenols, di and polyhydroxy aromatic compounds; (3) organometallic compounds such as metal chelates, e.g. with 1,3-diketones, ethylene diamine, ethylene diamine tetraacetic acid, phthalocyanines etc; (4) metal salts of organic amines such as aliphatic amines, aromatic amines, and quaternary ammonium compounds.

As indicated previously, the metal constituent of the metal catalyst compound or precursor is selected from the group consisting of Groups IIB, IVB, V-B, VI-B, VII-B and VIII of the Periodic Table of Elements, and mixtures thereof, in accordance with the table published by E. H. Sargent and Company, copyright 1962, Dyna Slide Company, that is, zinc, cadmium, mercury, tin, lead, vanadium, niobium, tantalum, chromium, molybdenum, tungsten, manganese, rhenium, iron, cobalt, nickel, and the noble metals including platinum, iridium, palladium, osmium, ruthenium and rhodium. The preferred catalyst compounds or precursors are the oil soluble metal compounds containing a metal selected from the group consisting of molybdenum, vanadium and chromium. More preferably, the metal constituent is selected from the group consisting of molybdenum and chromium. Most preferably, the metal constituent of an oil soluble metal compound is molybdenum. Preferred compounds of the metals include the salts of acyclic (straight or branched chain) aliphatic carboxylic acids, salts of alicyclic aliphatic carboxylic acids, heteropolyacids, hydrated oxides, carbonyls, phenolates and organo amine salts. More preferred types of metal compounds are the heteropoly acid, e.g. phosphomolybdic acid. Another preferred metal compound is a salt of an alicyclic aliphatic carboxylic acid such as the metal naphthenate. The most preferred compounds are phosphomolybdic acid, molybdenum naphthenate, vanadium naphthenate and chromium naphthenate. When an oil-soluble metal compound is added to the hydrogen donor solvent, it dissolves in the solvent and is readily dispersed. To form the catalyst, when a precursor is used, the metal compound (catalyst precursor) is converted in situ within the slurry of coal bottoms and hydrogen donor solvent during liquefaction.

In general, the catalyst will be added to the slurry at a concentration within the range from about 20 to about 2000 ppm, based on active metal, by weight of dry coal feed, such that the catalyst concentration in the liquefaction vessel will be within the range from about 30 to about 6000 ppm based on total solids depending upon the amount of bottoms recycled during the liquefaction operation. As will be made more apparent hereinafter, when multiple stages are employed the catalyst concentration in any particular stage may vary due to different amounts of bottoms recycled to different stages but the catalyst concentration within any given stage or zone will be within the aforementioned range of from about 30 to about 6000 ppm, based on active metal components, by weight of total solids.

After the solid carbonaceous material has been slurried, the slurry containing the dispersed or dissolved catalyst or catalyst precursor, recycled bottoms and the solid carbonaceous material will be subjected to liquefaction at a temperature within the range from about 650° to about 950° F. and at a pressure within the range from about 300 to about 3000 psig. The essence of the present invention resides in the discovery that for any given solid carbonaceous material and particularly for any given coal, the total conversion of carbon in the solid carbonaceous material to a liquid or gaseous product increases with the amount of donatable hydrogen contained in the solvent or diluent used during at least a portion of the liquefaction even when a hydrogenation catalyst is present.

As indicated previously, the liquefaction may be accomplished either in a single stage or in a plurality of stages. In any case, the total nominal holding time will, generally, range from about 25 to about 250 minutes. In general, the liquefaction will result in the production of a gaseous product, a liquid product and a normally solid bottoms product. After liquefaction these products may be separated into their respective phases using conventional techniques. The catalyst, in some form, will be contained in the solids bottom product.

When a single stage liquefaction system is used, the gaseous and lighter boiling liquid hydrocarbons may be flashed overhead, a portion of the remaining slurry recycled to the reactor as bottoms recycle and the remainder further fractionated in a second separator. In the second separator, a stream having an initial boiling point within the range from about 350° to about 425° F. and a final boiling point within the range from about 700° to about 800° F. will be separated. In a preferred embodiment, at least a portion of this stream will be subjected to hydrogenation and used as the hydrogen donor solvent or diluent containing at least 1.25 wt % donatable hydrogen. In addition, a second stream having an initial boiling point within the range from about 700° to about 800° F. and a final boiling point within the range from about 950° to about 1100° F. will be withdrawn as a product. A third stream having an initial boiling point within the range from about 950° to about 1100° F. will be withdrawn as bottoms and a portion of this stream may be recycled to the liquefaction zone or, depending primarily upon the carbon content thereof, burned or discarded. Alternatively, the gaseous and lower boiling liquid hydrocarbon products may be flashed overhead and the entire remainder of the slurry subjected to further separation to obtain at least the three fractions noted supra. When this is done, at least a portion of the bottoms will be recycled to the liquefaction zone.

It should be noted that when a portion of the entire slurry is recycled to the liquefaction zone, the load on the second separator will be reduced. As a result, the recycling of a portion of the entire slurry after the gaseous and lighter boiling liquid products are flashed overhead is preferred. When this is done, the recycled stream will have an initial boiling point within the range from about 350° to about 800° F. and will contain a portion of the unreacted solid carbonaceous material, a portion of the inert material contained in the solid carbonaceous material and a portion of the catalysts initially introduced.

When a plurality of liquefaction stages or zones are employed, at least the gaseous and lighter boiling liquid hydrocarbons will be separated between each stage. Generally, this separation will include all components having a boiling point below about 350° to about 450° F. Moreover, a portion of the remaining slurry may be recycled to the immediate previous stage as bottoms recycle. Further, at least a portion of the remaining product slurry may be further separated to yield a solvent or diluent fraction having an initial boiling point within the range from about 350° to about 425° F. and a final boiling point within the range from about 700° to about 800° F. All or a portion of this fraction may then be hydrogenated to produce a hydrogen-donor solvent containing at least 1.25 wt % donatable hydrogen which may be used in any one or all of the multiple liquefaction stages or zones. As will be pointed out more fully hereinafter, maximum carbon conversion will be realized when a good hydrogen-donor solvent is used in all of the stages. Surprisingly good conversions are, however, realized when a good hydrogen-donor solvent; i.e., a hydrogen-donor solvent containing at least 1.25 wt % donatable hydrogen, is used in the second or subsequent stages while a weaker hydrogen-donor solvent; i.e., a hydrogen donor solvent containing less than 1.25 wt % donatable hydrogen, is employed in the first stage. In this embodiment, then, less total solvent will be subjected to hydrotreating while significant carbon conversions are, generally, realized. The weaker donor solvents used in the first stage could, then, be spent solvent from one or more of the liquefaction stages.

After the liquefaction is completed the gaseous product from each stage may be upgraded to a pipeline gas or the same may be burned to provide energy for the liquefaction process. Alternatively, all or any portion of the gaseous product may be reformed to provide hydrogen for the liquefaction process.

The liquid products may be fractionated into essentially any desired product distribution and/or a portion thereof may also be used directly as a fuel or upgraded using conventional techniques. Generally, a naphtha boiling range fraction will be recovered and the naphtha fraction will be further processed to yield a high-quality gasoline or similar fuel boiling in the naphtha range.

The broader embodiment of the present invention is illustrated in FIG. 1 and it is believed that the invention will be better understood by reference to this figure. Referring, then, to FIG. 1, a finely divided coal or similar solid carbonaceous material is introduced into slurry preparation vessel 110 through line 111 and slurried with a readily dispersible catalyst or catalyst precursor introduced through line 112 and a hydrogen-donor solvent or diluent containing at least 1.25 wt % donatable hydrogen introduced through line 113. The coal or similar solid carbonaceous material will also be combined with a recycle bottoms slurry; i.e., a slurry comprising liquid product, including spent solvent, solid bottoms product and catalysts, generally in an active form, or recycle bottoms product introduced through line 114. Slurry formation is facilitated through the use of agitating means 115. Preferably, the hydrogen-donor solvent will be a distillate fraction cut from the liquefaction liquid product, separately hydrotreated such that the fraction contains at least 1.25 wt % donatable hydrogen and introduced into line 113 through line 116. As previously indicated, however, pure hydrogen-donor compounds may be used and when such compounds are used, they will, generally, be introduced through line 117. Moreover, solvents or diluents containing less than 1.25 wt % donatable hydrogen may be used during start-up of a continuous operation.

After the slurry is formed, the same will be withdrawn through line 118 and, generally, will be preheated to a temperature at or near liquefaction temperature with suitable means such as preheater 119. When desired, and particularly when the solid carbonaceous material has not been previously dried, steam may be flashed overhead from the preheater through line 120. Generally, the liquefaction will be accomplished at temperatures within the range from about 700° to about 950° F. when a single liquefaction zone is used.

In the embodiment illustrated, the slurry is withdrawn from the preheater through line 121 and passed directly to liquefaction vessel 122. In general, the liquefaction will be accomplished in the presence of molecular hydrogen which may be introduced directly into the liquefaction vessel through line 123. Hydrogen concentrations within the range from about 2 to about 10 weight percent based on coal are, generally, employed. Generally, the liquefaction vessel will be sized such that the nominal holding time of the slurry is within the range from about 25 to about 250 minutes.

In the liquefaction reactor, at least a portion of the carbonaceous material will be converted to normally gaseous hydrocarbons and another portion thereof will be converted to lower boiling, normally liquid hydrocarbons. Moreover, gaseous hydrocarbons and liquid materials will be released during the liquefaction. It has now been found that when the liquefaction is accomplished in the presence of a "once through" catalyst, the liquid yield is significantly increased. As used herein, the recitation "once through" catalyst shall mean a catalyst which is not separated from the bottoms or bottoms fraction prior to any recycle.

In the embodiment illustrated, the effluent from the liquefaction reactor is withdrawn through line 124 and passed to a first separation vessel 125. In the first separation vessel, the normally gaseous hydrocarbons and lighter boiling liquid hydrocarbons are flashed overhead through line 126. Unconsumed hydrogen and acid gases and other impurities such as ammonia will also be flashed overhead through line 126. The remaining portion of the liquefaction reactor effluent is withdrawn through line 127. The material withdrawn through line 127 will comprise the normally liquid hydrocarbons and particularly those boiling above the cut-point of the lighter hydrocarbons withdrawn through line 126, the heavier boiling hydrocarbons, unconverted solid carbonaceous material, mineral matter originally contained in the solid carbonaceous material and catalyst.

In one embodiment of the present invention, a portion of this material may be separated and returned to the slurry preparation zone effectively as bottoms recycle. When this is done, the separated or recycled portion will be withdrawn through line 114 and fed to the slurry preparation zone 110. As will be apparent, when this method of bottoms recycle is employed, it will not be necessary to recycle a more concentrated bottoms fraction.

That portion of the material withdrawn through line 127 which is not fed to the slurry preparation zone will then be passed to a second separation unit 128. In this separation unit, any number of distillate fractions may be cut. In the simplest embodiment, however, a solvent fraction having an initial boiling point within the range from about 350° to about 425° F. and a final boiling point within the range from about 700° to about 800° F. will be separated and withdrawn through line 129. A heavier fraction having an initial boiling point within the range from about 700° F. to about 800° F. and a final boiling point within the range from about 950° F. to about 1100° F. will be withdrawn through line 130 and a bottoms fraction having an initial boiling point within the range from about 950° to about 1100° F. will be withdrawn through line 131.

In that embodiment wherein a portion of the heavier material from separation vessel 125 is fed to slurry preparation zone 110, the entire bottoms fraction, i.e., the fraction having an initial boiling point within the range from about 950° F. to about 1100° F., may be discarded, subjected to further processing in accordance with conventional techniques or burned for its fuel value. When a portion of the heavier material is not withdrawn and fed directly to slurry preparation zone 110, however, a portion of the bottoms fraction withdrawn through line 131 will be fed to the slurry preparation zone as "bottoms recycle". The recycle will be accomplished through lines 114' and 114. In either case, from about 10 to about 60 wt % of the fraction having an initial boiling point within the range from about 950° to about 1100° F. will be recycled or fed to the slurry preparation zone 110. In general, the bottoms withdrawn through line 131 will comprise from about 20 to about 70 wt % solid carbonaceous material and from about 30 to about 80 wt % mineral matter.

Generally, the lighter stream withdrawn through line 126 will contain all components boiling below a temperature within the range from about 350° to about 425° F. This stream will, generally, be cool and further separated into a vapor phase and a liquid phase with equipment not illustrated. Normally, the vapor stream will contain low boiling point liquids and gases and may be: employed as a fuel gas for the generation of process heat; steam reformed to produce hydrogen; or used for other purposes. Generally, acid gases and similar impurities such as ammonia will be removed from this stream prior to subsequent use. The liquids separated by cooling will, generally, boil in the gasoline range and may be upgraded using conventional techniques to a high-quality gasoline or similar fuel. Similarly, the liquid withdrawn through line 130 may be hydrocracked to lower boiling liquid fuels or the same may be used directly as a vacuum gas oil or similar fuel.

In general, the entire fraction withdrawn through line 129 or a sufficient portion thereof to provide the needed solvent will be hydrogenated in hydrogenation vessel 132. Excess liquid boiling in this range may be withdrawn through line 129' and used directly as a fuel or upgraded in accordance with conventional techniques. In general, any method may be employed to effect the desired hydrogenation and such methods are well known in the prior art. In general, the solvent hydrogenation reactor will, preferably, be operated at about the same pressure as that used in the liquefaction reactor 122 and the same will, generally, be operated at a lower temperature than that used during liquefaction. In this regard, it should be noted that the temperature, pressure and space velocity as well as the amount of hydrogen actually introduced into the hydrogenation reactor 132 through line 133 will depend upon the particular feed combination subjected to hydrogenation, the catalyst employed and other variables. Optimization of such operation is, however, well within the ordinary skill of the art and forms no part of the present invention. In any case, the hydrogenation zone will be operated such that from about 0.5 to about 2 weight percent hydrogen is taken up by the liquid product subjected to hydrogenation. Gas from the hydrogenation vessel will be withdrawn through line 134 and the hydrogen contained therein may be reused after suitable scrubbing. The liquid product is withdrawn through line 116 and fed to slurry preparation zone 110 through lines 116–113. Excess hydrogenated material may be withdrawn as product through line 116' or stored for subsequent use as a hydrogen-donor solvent.

In another embodiment of the present invention, the liquefaction will be accomplished in a plurality of stages wherein the gaseous products of liquefaction and the lighter boiling liquid products are separated between each stage while at least a portion of the higher boiling materials, unconverted solid carbonaceous material and the associated mineral matter is subjected to further liquefaction in a subsequent stage. The heavier fraction will, of course, comprise substantially all of the catalyst added initially during the liquefaction. Such an embodiment is illustrated in FIG. 2.

Figure 2:
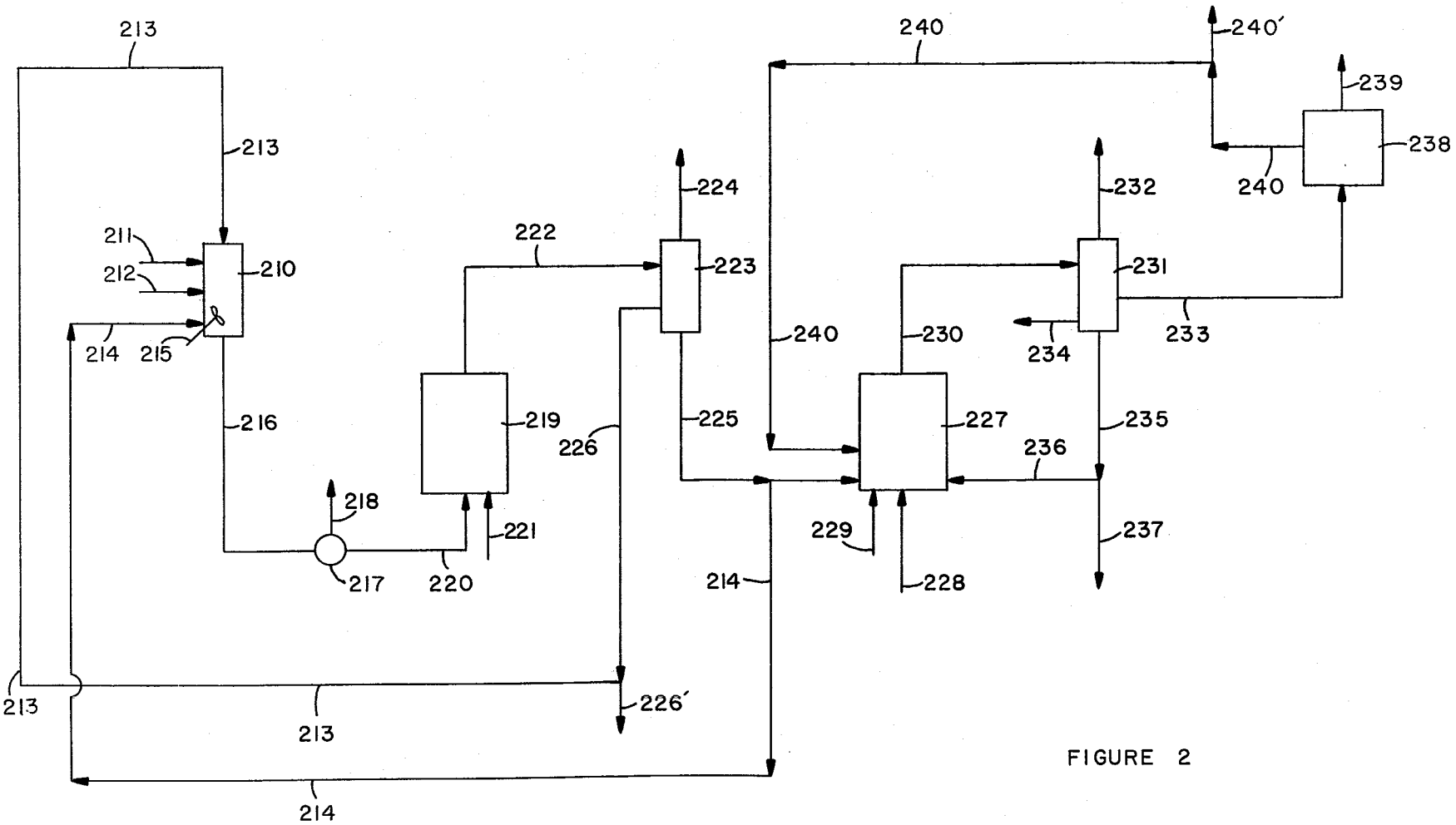
FIG. 2 is a schematic flow diagram of still another process within the scope of the present invention.

Referring to FIG. 2, a liquefaction slurry is again prepared in substantially the same manner as used in the preparation of a slurry for a single stage liquefaction. In the embodiment illustrated, then, a solid carbonaceous material is introduced into slurry preparation zone 210 through line 211 combined with a suitable catalyst or catalyst precursor introduced through line 212 and slurried with a suitable solvent introduced through line 213. As indicated more fully, hereinafter, it is not essential that the solvent introduced at this point be a hydrogen-donor solvent or that the solvent contain at least 1.25 wt % donatable hydrogen and, indeed, any of the solvents known to be useful in the liquefaction of a solid carbonaceous material may be used. Moreover, and as more fully indicated hereinafter, use of a distillate fraction from the liquefaction liquid product without separate hydrogenation thereof will be most convenient. In general, the catalyst will be introduced at the same concentration used in a single stage operation and the solid carbonaceous material will be slurried with bottoms from one or more of the liquefaction stages such that the bottoms in the slurry is within the range from about 20 to about 40 wt %, on a weight basis. As in the case of a single-stage operation, the bottoms may be introduced either by separating a portion of the heavier material from the effluent of one or more stages and recycling the entire heavier portion or by recycling a bottoms material having an initial boiling point within the range from about 950° to about 1100° F. In either case, the bottoms will be introduced into the slurry preparation zone 210 through line 214. Again, slurry preparation may be aided by a suitable mixing device such as agitator 215.

In the slurry preparation zone 210, a slurry comprising from about 10 to about 40 wt % solid carbonaceous material, on a moisture-free basis, from about 10 to about 40 wt % bottoms material having an initial boiling point within the range from about 950° to about 1100° F., from about 20 to about 2000 ppm catalyst, by weight on moisture-free solid carbonaceous material, and from about 20 to about 80 wt % solvent or diluent is prepared. The slurry is then withdrawn through line 216 and, generally, will be passed through preheater 217. In the preheater, the slurry will be preheated to a temperature generally within the range from about 10° to about 50° F. below the liquefaction temperature and when a moist, solid carbonaceous material has been used, moisture may be withdrawn from the preheater through line 218. The slurry is then passed to the first stage liquefaction vessel 219 through line 220. Generally, molecular hydrogen will be present during liquefaction and the molecular hydrogen may be introduced into the slurry at any convenient point or directly into the liquefaction reactor 219; e.g., through line 221. In general, molecular hydrogen will be added in an amount ranging from about 2 to about 10 weight percent based on solid carbonaceous material.

In general, the first liquefaction zone will be operated at a temperature within the range from about 650° to about 900° F. and the nominal residence time will be within the range from about 25 to about 125 minutes. The liquefaction will be accomplished at a pressure, generally, within the range from about 300 to about 3000 psig. As previously indicated, a catalytically active form of a Group II-B, IV-B, V-B, VI-B, VII-B or VIII metal will be present during liquefaction and the concentration of the catalyst will be within the range from about 30 to about 3,000 ppm by weight on solid carbonaceous material. In general, the amount of donatable hydrogen contained in the solvent will be within the range from about 0.0 to about 2.0 weight percent. The use of a solvent containing from about 0.3 to about 1.2 wt % donatable hydrogen is, however, preferred.

In the embodiment illustrated, the entire liquefaction reactor effluent will be withdrawn through line 222 and passed to a suitable separation means 223. In the separation means, it is within the scope of this invention to effect a broad range of separations. For example, it is within the scope of this invention to simply flash the normally gaseous liquefaction products and the lighter boiling liquids overhead and to then pass the entire heavier portion to a second stage liquefaction. When this is done, the separating unit 223 will be operated such that the normally gaseous and lighter boiling materials are withdrawn through line 224 while the heavier boiling fraction, including any mineral matter contained in the solid carbonaceous material feed as well as any recycled to the first stage liquefaction zone and all of the catalysts added to the first stage liquefaction zone are withdrawn through line 225. Generally, and when this particular mode of operation is employed, the cut point between the lighter and heavier fractions will be from about 350° F. to about 600° F. In a more preferred mode of operation, however, the separation unit will be operated such that a third distillate fraction is separated. Generally, this fraction will have an initial boiling point within the range from about 350° to about 425° F. and a final boiling point within the range from about 700° to about 800° F. In the embodiment illustrated, this distillate fraction will be withdrawn through line 226. In general, this fraction is suitable for use as a solvent or diluent and generally will contain from about 0.3 to about 1.2 wt % donatable hydrogen as separated in separation unit 223. This fraction is, then, particularly suitable for use directly as a solvent or diluent in the first stage liquefaction. Moreover, and as is well known, this fraction could be subjected to hydrogenation to increase the concentration of donatable hydrogen. In the embodiment illustrated, however, at least a portion of this fraction will be used as the solvent or diluent in the first stage without such hydrogenation and the same will be fed to slurry preparation zone 210 through line 214. Any surplus or excess material contained in this fraction may be withdrawn through line 226'. The lighter fraction withdrawn overhead through line 224 may be further processed to yield both a gaseous fuel and a liquid fuel in the same manner previously discussed with respect to the single stage operation. Such further processing may, of course, be accomplished separately or this overhead stream could be combined with the overhead streams from the second and subsequent liquefaction stages or zones.

The heavier fraction withdrawn through line 225 is then passed to second stage liquefaction vessel 227. As will be apparent from the discussion, supra, the composition of this fraction will vary depending primarily upon whether one or two streams are separated in separating unit 223. Moreover, it is within the scope of this invention to separate a portion of this heavier fraction through line 214 as a source of bottoms for the first stage liquefaction. As indicated more fully hereinafter, however, the bottoms for the first stage liquefaction may be provided from the second or subsequent liquefaction zone.

In the second stage liquefaction zone, the heavier fraction will be combined with a hydrogen-donor solvent containing at least 1.25 wt % donatable hydrogen introduced through line 228. Sufficient hydrogen-donor solvent will be added to provide a solvent to solids ratio within the range from about 0.8 to about 10. Generally, molecular hydrogen will also be present during the second stage liquefaction and in the embodiment illustrated molecular hydrogen may be introduced through line 229.

In the second stage liquefaction zone, the solid carbonaceous material will be subjected to liquefaction at a temperature within the range from about 700° F. to about 950° F. and the nominal residence time will be within the range from about 25 to about 125 minutes. The liquefaction will be accomplished at a pressure within the range from about 300 to about 3000 psig. Due to the concentration of catalysts as a result of the separation of normally gaseous and lighter boiling liquid materials in separation unit 223, the catalyst concentration will be approximately twice that as is present in the first stage liquefaction zone. Also, a donor solvent will be used in this stage and the same will contain at least 1.25 wt % donatable hydrogen and preferably from about 1.25 to about 2 weight percent donatable hydrogen. In the embodiment illustrated, the entire liquefaction effluent will be withdrawn from the second stage liquefaction zone through line 230 and passed to separating unit 231.

In the separation unit 231 a lighter fraction comprising the normally gaseous components and the lower boiling hydrocarbons will be flashed overhead through line 232. Generally, this stream will have a final boiling point within the range from about 350° to about 425° F. A second stream having an initial boiling point within the range from about 350° to about 425° F. and a final boiling point within the range from about 700° to about 800° F. will be withdrawn through line 233. A third liquid stream having an initial boiling point of about 700° to about 800° F. and a final boiling point within the range from about 950° to about 1100° F. will be withdrawn through line 234. Finally, a bottoms fraction having an initial boiling point within the range from about 950° to about 1100° F. will be withdrawn through line 235. This fraction will contain catalysts in an active form and at least a portion thereof will be fed to second stage liquefaction unit 227 through line 236. Sufficient bottoms will be fed to the second stage liquefaction unit to provide a ratio of bottoms from the first stage to bottoms from the second stage within the range from about 0.25:1 to about 4.0:1, by weight. Excess bottoms may be withdrawn through line 237. Depending upon the carbon content, these bottoms may be further processed to a subsequent liquefaction stage; used to produce hydrogen or a low BTU gas; burned for fuel value, or discarded.

The lighter fraction withdrawn through line 232 may be further processed to provide a pipeline quality gas and a liquid boiling in the naphtha range. When required, acid gases and similar impurities will be separated via scrubbing or other techniques well known in the prior art. The stream withdrawn through line 234 may be upgraded via hydrocracking or similar operations to yield lighter fuel fractions. This fraction may, however, be used directly as a fuel.

The fraction withdrawn through line 233 or at least a portion thereof will be hydrotreated to provide a solvent fraction having a donatable hydrogen concentration within the range desired in the second stage liquefaction unit 227. In the embodiment illustrated, the hydrogenation will be accomplished in hydrogenation unit 238, gaseous products of hydrogenation and unconsumed hydrogen will be withdrawn through line 239. The hydrogenated solvent is fed to the second stage liquefaction unit through line 240 and any excess may be withdrawn through line 240'. The excess may be used directly as a fuel or saved for subsequent use as a hydrogen-donor solvent.

DESCRIPTION OF THE PREFERRED EMBODIMENTS

In a preferred embodiment of the present invention liquefaction of coal will be accomplished in a two-stage operation. In the first stage, liquefaction will be accomplished in the presence of a solvent having from about 0.3 to about 2.0 weight percent donatable hydrogen, most preferably 0.8 to 1.2 weight percent donatable hydrogen and the solvent for the second stage will be separated from the first stage liquefaction reactor effluent and hydrogenated prior to use as a solvent. In the second liquefaction stage, the solvent will contain at least 1.25 wt % donatable hydrogen and most preferably from about 1.25 to about 2.0 wt % donatable hydrogen. Such an embodiment is illustrated in FIG. 3.

Figure 3:
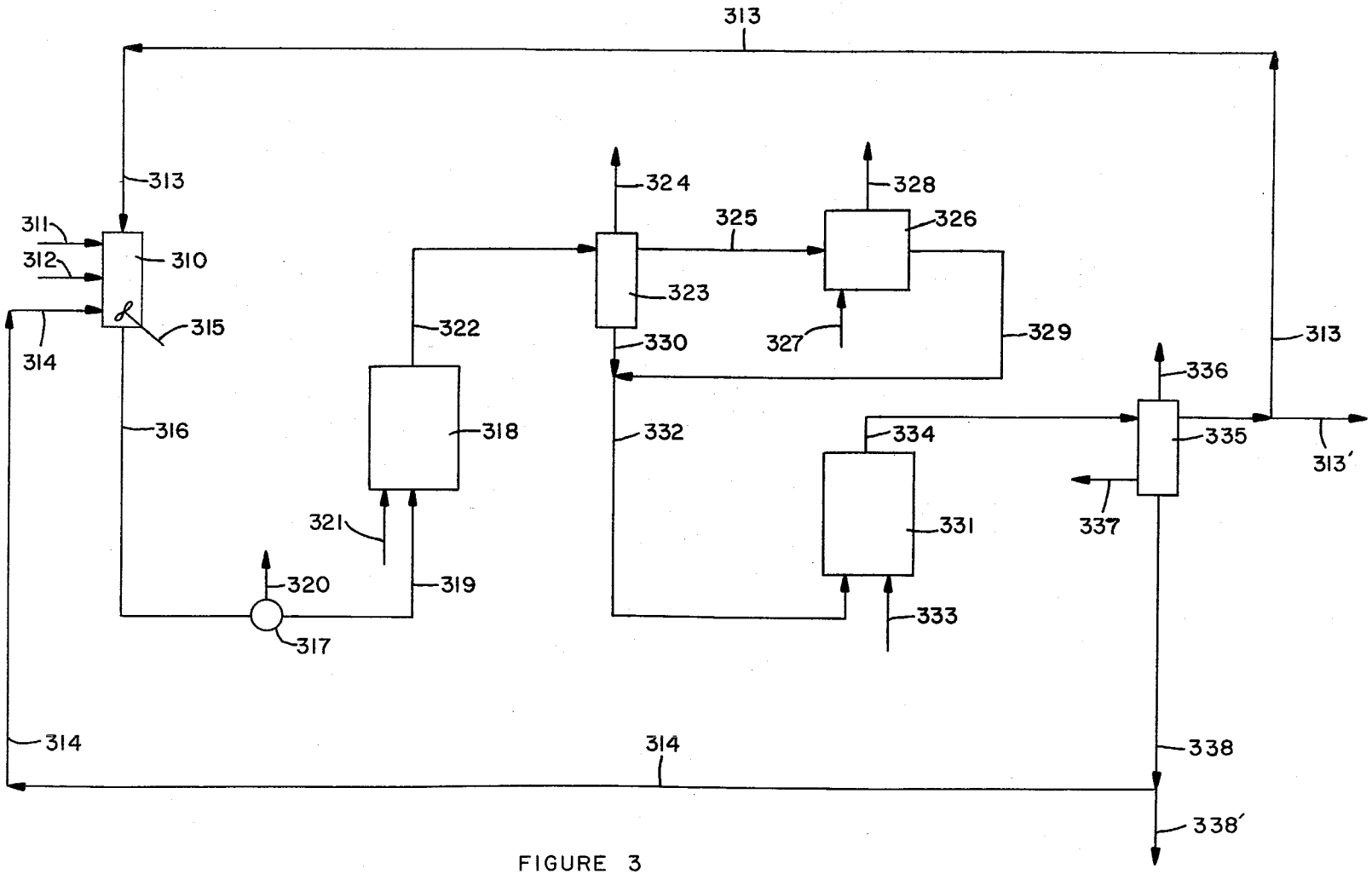
FIG. 3 is a schematic flow diagram of yet another process within the scope of the present invention.

Referring, then, to FIG. 3, a finely divided coal is introduced into slurry preparation vessel 310 through line 311 and combined, preferably, with from about 100 to about 1000 ppm, by weight based on coal, of phosphomolybdic acid introduced through line 312. The slurry also will contain from about 0.4 to about 1.5 parts of bottoms per part of coal, by weight, said bottoms being separated from the second stage liquefaction vessel and having an initial boiling point within the range from about 950° to about 1100° F. The catalyst introduced into the slurry vessel will be in addition to any catalyst contained in these recycled bottoms. The slurry will be prepared in a solvent cut from the second stage liquefaction unit having an initial boiling point within the range from about 350° to about 425° F. and a final boiling point within the range from about 700° to about 800° F. The solvent to coal ratio in the slurry will be within the range from about 1:1 to about 3:1, on a weight basis. The solvent will be introduced through line 313 and the recycled bottoms will be introduced through line 314. Suitable means such as agitator 315 will be used to facilitate slurry preparation.

The slurry will be withdrawn through line 316, passed through preheater 317 and then into the first stage liquefaction unit 318 through line 319. Moisture in the coal may be withdrawn through line 320.

In the first stage liquefaction zone, liquefaction will be accomplished in the presence of molecular hydrogen introduced through line 321. In the preferred embodiment, the liquefaction will be accomplished at a temperature within the range from about 800° F. to about 880° F. and at a pressure within the range from about 1500 to about 2500 psig. The nominal residence time will be within the range from about 40 to about 60 minutes. As a result of liquefaction, gaseous and liquid products will be liberated and formed and the entire liquefaction effluent will be withdrawn through line 322 and passed to separation unit 323.

In the separation unit 323, and in a preferred embodiment, a lighter fraction containing the normally gaseous products and the lighter boiling liquid products will be withdrawn overhead through line 324. In the preferred embodiment, this stream will have a final boiling point within the range from about 350° to about 425° F. A second stream having an initial boiling point within the range from about 350° to about 425° F. and a final boiling point within the range from about 700° to about 800° F. will be withdrawn through line 325. The entire fraction will be passed to hydrogenation unit 326 and hydrogenated to increase the donatable hydrogen content to at least 1.25 wt % and most preferably to a concentration within the range from about 1.25 to about 2.0 wt %. Molecular hydrogen introduced through line 327 will be used to effect the hydrogenation at a temperature within the range from about 600° to about 700° F. and in the presence of a nickel-moly hydrogenation catalyst. The hydrogenation will be accomplished at a pressure within the range from about 1000 to about 3000 psig. Gaseous products and unconsumed hydrogen will be withdrawn through line 328. The hydrogen may be recovered for reuse using conventional technology.

The hydrogenated liquid fraction will be withdrawn through line 329, combined with the heavier fraction from separation unit 323 withdrawn through line 330, and passed to second stage liquefaction vessel 331 through line 332. In the preferred embodiment, the entire hydrogenated fraction will be used as a solvent in the second stage liquefaction.

The second stage liquefaction will be accomplished in the presence of molecular hydrogen which may be introduced through line 333. The second stage liquefaction will, preferably, be accomplished at a temperature within the range from about 800° to about 880° F. and at a pressure within the range from about 1500 to about 2500 psig. The nominal residence time will, again, be within the range from about 40 to about 60 minutes. The catalyst concentration in the second stage liquefaction vessel, based on total solids, will be approximately twice the catalyst concentration in the first stage. The entire liquefaction effluent will be withdrawn through line 334 and passed to separation unit 335.

In the separation unit, a light fraction containing the normally gaseous products and the lighter boiling liquid products will be withdrawn overhead through line 336. Again, this fraction will have a final boiling point within the range from about 350° to about 425° F. and in a preferred embodiment will be combined with the lighter fraction withdrawn through line 324 prior to scrubbing and further separation. A second fraction having an initial boiling point within the range from about 350° to about 425° F. and a final boiling point within the range from about 700° to about 800° F. will be withdrawn through line 313 and fed to slurry preparation zone 310. Any excess solvent may be withdrawn as product through line 313'. A third fraction having an initial boiling point within the range from about 700° to about 800° F. and a final boiling point within the range from about 950° to about 1100° F. will be withdrawn through line 337. As in previous embodiments, this fraction may be upgraded via hydrocracking or used directly as a fuel. Finally, a bottoms fraction having an initial boiling point within the range from about 950° to about 1100° F. will be withdrawn through line 338. This stream will contain higher boiling liquids, unconverted coal and all of the catalyst introduced into the process. At least a portion of this stream will be fed to the slurry preparation zone 310 through line 314. Excess bottoms may be withdrawn through line 338' and, generally, will be treated to recover catalyst prior to further processing or discarding.

Having thus broadly described the present invention and a preferred and most preferred embodiment thereof, it is believed that the same will become even more apparent by reference to the following examples. It will be appreciated, however, that the examples are presented solely for purposes of illustration and should not be construed as limiting the invention.

EXAMPLE 1

In this example a series of runs were completed with an Illinois #6 coal in a bench scale unit. In each run, the particle size of the coal was −100 mesh. In each of the series of runs, a slurry was prepared containing 39 weight percent coal and 1000 ppm of molybdenum naphthenate based on dry coal. In each run, the liquefaction was accomplished at 800° F., 1000 psig initial hydrogen charge and with a nominal residence time of 120 minutes. Molecular hydrogen was added to the liquefaction reactor in an amount of 6 weight percent based on dry coal. In the first run, a solvent having an initial boiling point of 400° F. and a final boiling point of 750° F. was used. The donor hydrogen content at the time of slurry preparation was controlled at 0.8 weight percent. In a second run, the slurry was prepared with a solvent containing 1.25 wt % donatable hydrogen and in a third run the donor hydrogen content at the time of slurry preparation was controlled at 1.45 wt %. The $C_4$-1000° F. liquid yield for each run is summarized below:

| Run # | Donatable Hydrogen Weight Percent | Liquid Yield Wt. % on Coal |
|---|---|---|
| 1 | 0.8 | 47.2 |
| 2 | 1.25 | 52.8 |
| 3 | 1.45 | 53.6 |

From the foregoing it is believed apparent that liquid yield increases with the amount of donatable hydrogen in the solvent used to prepare the slurry and that increased liquid yields are achieved when the solvent is externally hydrogenated to a donatable hydrogen content of at least 1.25 wt %.

EXAMPLE 2

In this example, a series of runs were completed in a continuous unit having a configuration identical to that illustrated in FIG. 2. Each run was started with a hydrogenated creosote oil as the solvent but at steady state, the slurry was prepared with a distillate fraction from the first stage liquefaction product having an initial boiling point of 400° F. and a final boiling point of 850° F. The solvent was not externally hydrogenated prior to slurry preparation. In each run, an Illinois #6 coal having a particle size of −100 mesh was used. In each run, 1/5 of the liquefaction reactor effluent from the first stage having an initial boiling point of about 850° F. was fed to the slurry preparation zone 210 to yield a slurry comprising 48 weight percent coal on a dry basis, 24 weight percent bottoms and a solvent to coal ratio of 1.6. The slurry contained 500 ppms phosphomolybdic acid based on dry coal. The first stage liquefaction was accomplished at 800° F., 2500 psig and with a nominal residence time of 120 minutes in the first stage liquefaction vessel 219. Hydrogen was continuously introduced at a rate of 9 weight percent based on dry coal. In each run, following the first stage liquefaction, the liquefaction effluent was separated into three streams; the first containing the normally gaseous components and the lighter boiling liquid components. The lighter stream had a final boiling point of about 425° F. A second stream having an initial boiling point of about 425° F. and a final boiling point of about 850° F. was separated and the entire stream was used as a solvent during slurry preparation. The third stream was the remaining heavier fraction having an initial boiling point of about 850° F. As previously indicated, 1/5 of this third stream was fed to the first stage slurry preparation and the remaining 4/5 were subjected to further liquefaction in a second stage such as second stage liquefaction zone 227. In each run, the second stage liquefaction was effected in the presence of a hydrogen-donor solvent which was separated from the second stage liquefaction reactor effluent and externally hydrogenated to a controlled amount of hydrogen-donor solvent. The amount was varied in each run and in a fourth run, presented for purposes of comparison, the solvent was not hydrogenated. Liquefaction in the second stage was accomplished at a temperature of about 840° F., a pressure of 2500 psig and the nominal residence time was 40 minutes. The liquefaction was accomplished in the presence of molecular hydrogen which was continuously added at a rate of 5 weight percent based on solids from the first stage liquefaction. The liquefaction was also accomplished in the presence of bottoms from the second stage liquefaction having an initial boiling point of about 1000° F. The bottoms were added to the second stage liquefaction reactor such that the initial ratio of bottoms to solids in the feed was 1:1. The entire effluent from the second stage liquefaction reactor was then separated into four streams: the first containing the normally gaseous components; the second having an initial boiling point of 425° F. and a final boiling point of 850° F.; the third having an initial boiling point of 850° F. and a final boiling point of 1000° F. and the fourth having an initial boiling point of about 1000° F. The lighter stream from both the first and second stage were combined and a liquid naphtha fraction recovered therefrom. Similarly, the entire fraction having an initial boiling point of 850° F. and a final boiling point of 1000° F. was withdrawn as liquid product. Moreover, a portion of the stream having an initial boiling point of 425° F. and a final boiling point of 850° F. was withdrawn as product while the remainder was used as solvent in the second stage liquefaction vessel. In the first run, the amount of donatable hydrogen was controlled at 0.8 weight percent. In the second run, the amount of donatable hydrogen was controlled at 1.25 weight percent and in the third run, the donatable hydrogen was controlled at 1.45 weight percent. In the fourth run, the solvent was used without external hydrogenation and the equilibrium donatable hydrogen content was 1.1. The liquid conversion from each of these runs is summarized below:

| Run # | Donatable Hydrogen Weight Percent | Liquid Yield Wt. % on Coal |
|---|---|---|
| 1 | 0.8 | 52 |
| 2 | 1.25 | 59 |
| 3 | 1.45 | 61 |

-continued

| Run # | Donatable Hydrogen Weight Percent | Liquid Yield Wt. % on Coal |
|---|---|---|
| 4 | 1.1 | 58 |

EXAMPLE 3

If the runs of Example 2 were repeated in a configuration identical to that illustrated in FIG. 3, such that the first stage liquefaction slurry is prepared with unhydrogenated solvent separated from the second stage liquefaction reactor. In each run, the solvent used in the first stage liquefaction would be identical to that used in the runs of Example 2. Bottoms having an initial boiling point of about 1000° F. would be used in the preparation of the first stage liquefaction slurry and the bottoms would be taken from the second stage liquefaction effluent. The same bottoms would be introduced into the second stage liquefaction zone and the amount recycled would be controlled such that the concentration of bottoms in each stage is identical to that used in the second stage. In each run, a liquid fraction having an initial boiling point of 425° F. and a final point of 850° F. would be separated from the first stage liquefaction effluent and hydrogenated to a controlled donatable hydrogen content. In the first three runs, the concentration was controlled at the same values as were used in the runs of Example 2. In a fourth run, this fraction would not be hydrogenated and the equilibrium concentration of donatable hydrogen would be 1.1 weight percent. The liquid yields obtained in each run are summarized below:

| Run # | Donatable Hydrogen Weight Percent | Liquid Yield Wt. % on Coal |
|---|---|---|
| 1 | 0.8 | 55 |
| 2 | 1.25 | 62 |
| 3 | 1.45 | 64 |
| 4 | 1.1 | 61 |

From the foregoing examples, it is believed readily apparent that improved liquid yields are realized when the solvent used in at least one liquefaction stage is separately hydrogenated to a controlled donatable hydrogen concentration. It is also believed readily apparent that increased liquid yields are realized when the amount of donatable hydrogen in the solvent is at least 1.25 wt %. Further, it is believed readily apparent that increased liquid yields are realized when the solvent is separated from a first stage liquefaction effluent and used as the solvent in a second stage liquefaction.

EXAMPLE 4

In this example two runs were completed with an Illinois #6 coal from Monterey mine in a continuous Recycle Coal Liquefaction Unit (RCLU) with a nominal capacity of 100 lbs dry coal per day. In each run, the particle size of the coal was −100 mesh. In both runs, a slurry was prepared containing 23 wt % coal, 23 wt % bottoms from the liquefaction reactor and 100 ppm molybdenum makeup as phosphomolybdic acid based on dry coal. In each run, the liquefaction was accomplished at 800° F., 2500 psig hydrogen pressure and with a nominal residence time of 120 minutes. Molecular hydrogen was added to the liquefaction reactor in an amount of 9 wt % based on dry coal. In the first run, the hydrotreater was bypassed. The recycle solvent having an initial boiling point of 425° F. and a final boiling point of 850° F., reached a steady-state at 1.1 wt % donatable hydrogen. In the second run, the slurry was prepared with a solvent containing 1.50 wt % donatable hydrogen, which was generated by hydrotreating the spent solvent from liquefaction reactor. The naphtha ($C_4$-400° F.) and total liquid yield ($C_4$-1000° F.) for both runs are summarized below:

| Run # | Donatable Hydrogen, Wt % | Naphtha, Wt % on Coal | Liq Yld, Wt % on Coal | % Naphtha on Liquid |
|---|---|---|---|---|
| 1 | 1.1 | 22 | 50 | 44 |
| 2 | 1.5 | 36 | 53 | 68 |

From the foregoing it is believed apparent that the valuable naphtha yield increases with the amount of donatable hydrogen in the solvent used to prepare the slurry and that increased liquid yields are achieved when the solvent is externally hydrogenated to a donatable hydrogen content of 1.5 wt %.

While the present invention has been described and illustrated by reference to particular embodiments thereof, it will be appreciated by those of ordinary skill in the art that the same lends itself to variations not necessarily illustrated herein. For this reason, then, reference should be made solely to the appended claims for purposes of determining the true scope of the present invention.

Having thus described and illustrated the invention, what is claimed is:

1. A process for the liquefaction of a solid carbonaceous material wherein the solid carbonaceous material is at least partially liquefied in a plurality of stages and in the presence of an added hydrogenation catalyst, which catalyst is present in all stages, wherein a solvent containing at least 1.25 wt. % donatable hydrogen is used in the second or subsequent stages while a hydrogen donor solvent containing less than 1.25 wt. % donatable hydrogen is employed in the first stage and wherein the liquefaction is accomplished in the presence of a residue comprising partially liquefied solid carbonaceous material, which residue comprising partially liquefied solid carbonaceous material is separated from the liquefaction product, and at a temperature within the range from about 650° F. to about 950° F. and at a pressure within the range from about 300 to about 3000 psig to produce a gaseous product, a liquid product and a normally solid bottoms product.

2. The improvement of claim 1 wherein the liquefaction effluent from the last stage is separated to yield a liquefaction distillate fraction having an initial boiling point within the range from about 350° F. to about 425° F. and a final boiling point within the range from about 700° F. to about 800° F., which distillate fraction is separately hydrogenated and used in part, at least, as the solvent and a bottoms fraction having an initial boiling point within the range from about 950° F. to about 1100° F. and wherein a portion of the bottoms fraction is used as the residue during liquefaction.

3. The improvement of claim 1 wherein a light boiling fraction having a final point within the range from about 350° F. to about 650° F. is separated from the effluent from the first liquefaction stage, a portion of the heavier boiling fraction having an initial boiling point within the range from about 350° F. to about 650° F. is recycled to the first stage as residue and the remaining portion of the heavier fraction is subjected to further liquefaction in a second or subsequent stage.

4. The improvement of claim 1 wherein a heavy boiling fraction having an initial boiling point within the range from about 350° F. and 425° F. is separated from the effluent of the first stage, a portion of the heavier fraction having an initial boiling point within the range from about 350° F. to about 425° F. is recycled to the first stage as bottoms and the remaining portion of the heavier fraction is further separated to yield a distillate fraction having an initial boiling point within the range from about 350° to about 425° F. and a final boiling point within the range from about 700° F. to about 800° F. and wherein at least a portion of this fraction is used directly as a solvent in the first stage and wherein the remainder of the heavier fraction is subjected to further liquefaction in a second or subsequent liquefaction stage.

5. The improvement of claim 4 wherein the second or subsequent stage liquefaction effluent is separated into a light fraction having a final boiling point within the range from about 350° F. to about 425° F., a middle distillate fraction having an initial boiling point within the range from about 350° F. to about 425° F. and a final boiling point within the range from about 700° to about 800° F. and a bottoms fraction having an initial boiling point within the range from about 950° F. and 1100° F. and wherein at least a portion of the middle distillate fraction is separately hydrogenated such that the same contains at least 1.25 wt % donatable hydrogen and wherein at least a portion of this fraction is used as a solvent in the second or subsequent stage and wherein at least a portion of the bottoms fraction is returned to the second or subsequent stage liquefaction.

6. The improvement of claim 1 wherein a middle distillate having an initial boiling point within the range from about 350° F. to about 425° F. is separated from the effluent from the first stage and is hydrogenated such that the same contains at least 1.25 wt. % donatable hydrogen and wherein at least a portion of this fraction is used as the solvent in the second or subsequent stage.

7. The improvement of claim 6 wherein the effluent from the second or subsequent stage is separated into a lighter fraction having a final boiling point within the range from about 350° to about 425° F. a middle distillate fraction having an initial boiling point within the range from about 350° F. to about 425° F. and a bottoms fraction having an initial boiling point within the range from about 950° F. to about 1100° F. and wherein at least a portion of the middle distillate fraction is used directly as the solvent in the first stage and wherein a portion of the bottoms fraction is recycled to the first stage as residue and another portion of the bottoms fraction is recycled to the second or subsequent stage as residue.

8. The improvement of claim 1 wherein the catalyst or catalyst precursor is added to a slurry of the solid carbonaceous material and solvent or diluent at a concentration within the range from about 20 to about 2000 ppm, based on active metal.

9. The improvement of claim 8 wherein the catalyst or catalyst precursor is added as an oil soluble metal compound.

10. The improvement of claim 9 wherein the catalyst or catalyst precursor is phosphomolybdic acid added at a concentration within the range from about 100 to about 1000 ppm by weight based on coal.

* * * * *